United States Patent [19]

Lejdegard

[11] 4,062,389

[45] Dec. 13, 1977

[54] SCREW APPLICATOR

[75] Inventor: Sixten H. Lejdegard, Ramnas, Sweden

[73] Assignee: Bulten-Kanthal AB, Sweden

[21] Appl. No.: 654,785

[22] Filed: Feb. 3, 1976

[30] Foreign Application Priority Data

Feb. 3, 1975 Sweden ..... 7501171

[51] Int. Cl.[2] ..... B25B 23/00

[52] U.S. Cl. ..... 144/32 R; 29/240; 29/809; 227/136

[58] Field of Search ..... 81/52.4, 57; 29/211 R, 29/208 C, 212 R, 240; 408/13; 145/52; 226/167, 157; 227/136, 149; 144/32

[56] References Cited

U.S. PATENT DOCUMENTS

| | | | |
|---|---|---|---|
| 3,205,925 | 9/1965 | Wiley | 144/32 |
| 3,601,168 | 8/1971 | Fernstrom | 144/32 |
| 3,613,751 | 10/1971 | Juhas | 144/32 |
| 3,642,039 | 2/1972 | McGee | 144/32 |

*Primary Examiner*—Harrison L. Hinson
*Assistant Examiner*—W. D. Bray
*Attorney, Agent, or Firm*—Hill, Gross, Simpson, Van Santen, Steadman, Chiara & Simpson

[57] ABSTRACT

A screw tightening apparatus comprising a motor-driven tool, a screw magazine for screws affixed to a strip-like carrier, and a screw advancing and tightening means for advancing the screws one at a time to a standby position in which a motor-driven bit may engage the screw for applying the same. A bell crank has a spring arm for advancing the screw strip and a drive arm driven by a projection on a plunger against the force of a feed spring to a cocked position, preparatory to advancement of the screw strip, the cocked position being maintained by a pivoted pawl which has a hook that locks the bell crank in such cocked position. A second projection on the plunger member engages the pawl to effect unlocking thereof near the end of a retracting stroke of the plunger member, whereby the feed spring drives the bell crank to advance the strip. A novel means for unlocking a spring-loaded axially slidable lock sleeve is provided. Further, a punch and die structure surround the screw head and cut a washer-like portion from the strip as the screw is applied.

14 Claims, 12 Drawing Figures

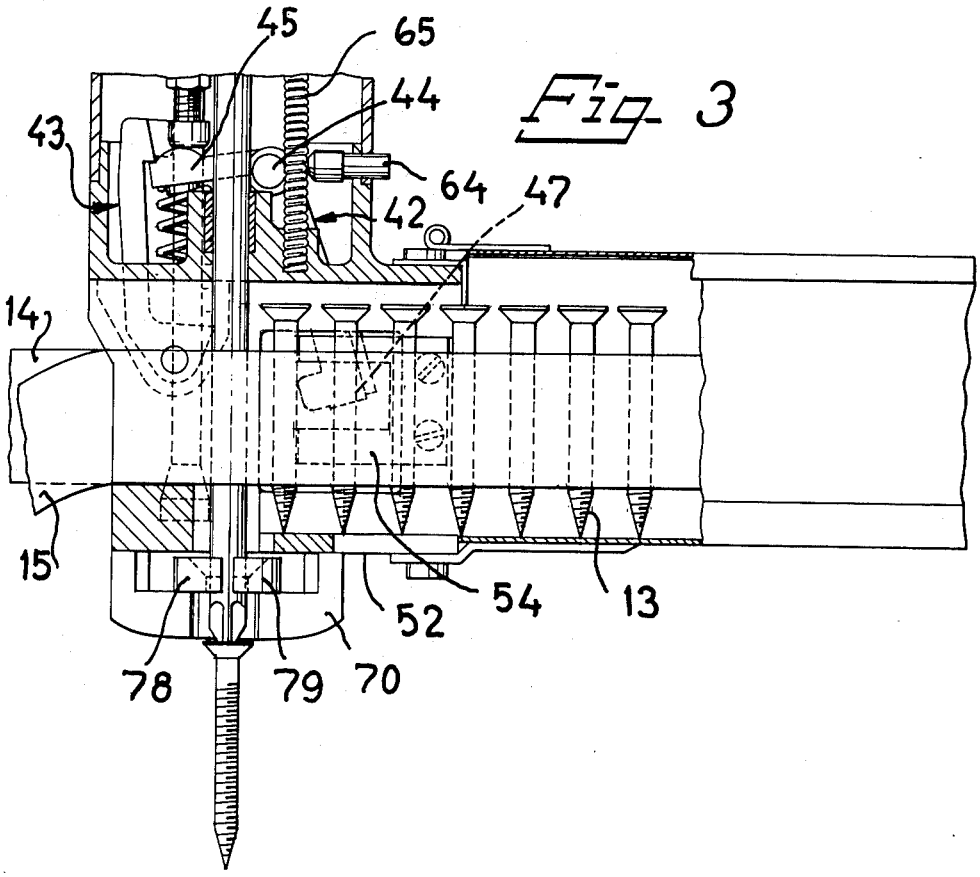
Fig. 3
Fig. 4
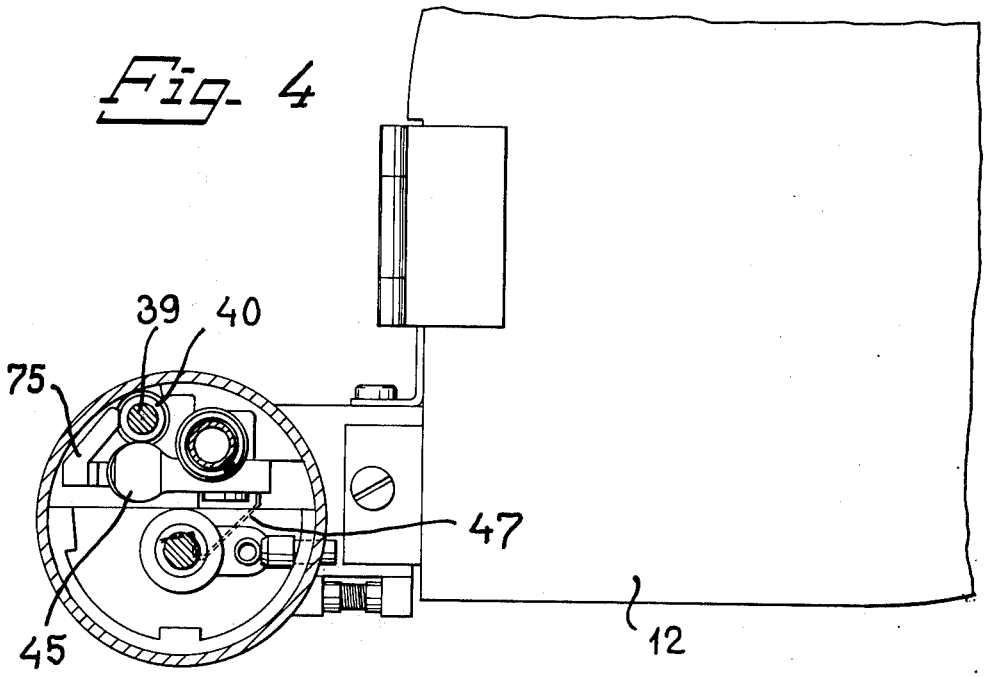

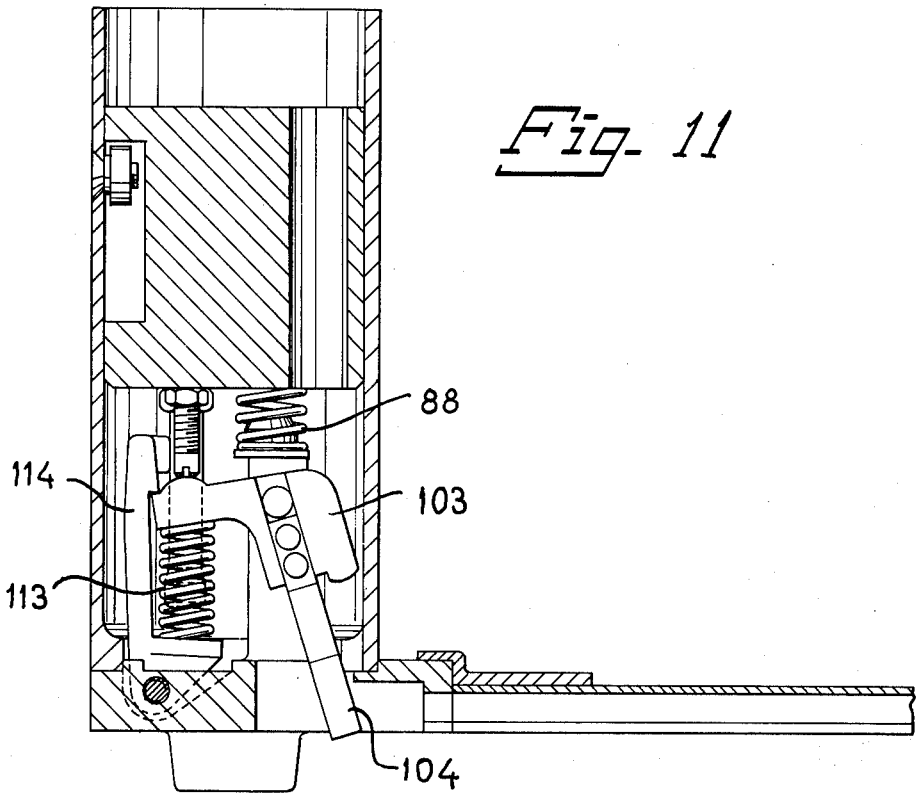
Fig. 11
Fig. 12
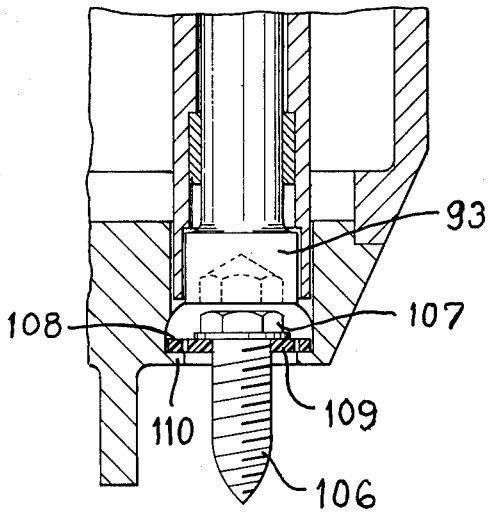

SCREW APPLICATOR

BACKGROUND OF THE INVENTION

1. Field of the Invention

This invention relates to a screwdriver of the type comprising a power-driven tool, a magazine for screws on a strip or the like, and a feeding and driving mechanism to feed the screws successively to a stand-by position for driving, where a bit or a key in the power-driven tool may be brought into engagement with the screw to drive the same.

2. Prior Art

A screwdriver of this type is described in U.S. patent application Ser. No. 561,287, filed Mar. 24, 1975, now U.S. Pat. No. 4,014,225. This prior screwdriver operates satisfactorily and has been met with approval. However, the feeding and driving mechanism of this screwdriver comprises a comparatively large number of cooperating parts, which circumstance makes the screwdriver rather expensive to produce and rather difficult to maintain and repair.

SUMMARY OF THE INVENTION

This invention is embodied in a screwdriver wherein the above-mentioned drawbacks are avoided while certain advantages are achieved, which is described in detail below.

According to one aspect of the invention, there is provided a bell crank for feeding the strip and driven by a projection on the plunger member to a cocked position of readiness for advancing the next screw to a standby position, the bell crank loading a feed spring which also pivots a pawl into bell-crank-retaining position, there being a second projection on the plunger member operative on the pawl, near the end of the retraction stroke of the plunger means, to release the pawl and hence effect a screw feed by the bell crank. An optional feature is a means for unlocking a spring loaded lock sleeve that retains the bit or tool. Another optional feature is a clamping sleeve and punch surface for removing washer-like portions of the strip with each screw.

ON THE DRAWINGS

FIG. 3 is an axial longitudinal cross-sectional view of the lower part of the screwdriver of FIGS. 1 and 2, the parts being shown at the end of a screwdriving stroke;

FIG. 4 is a cross-sectional view of the screwdriver of FIGS. 1 and 2;

Figure 6:
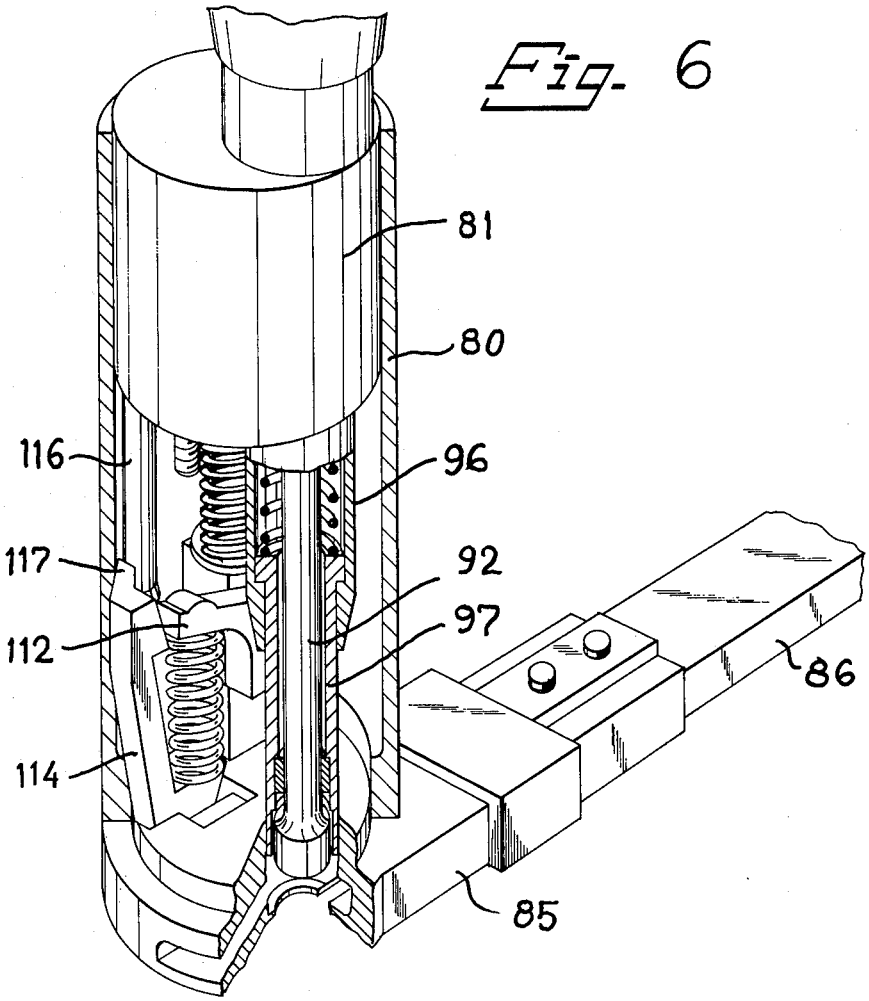
FIG. 6 is a perspective view, partly in cross-section, of a second embodiment of the screwdriver according to the invention.
Figure 7:
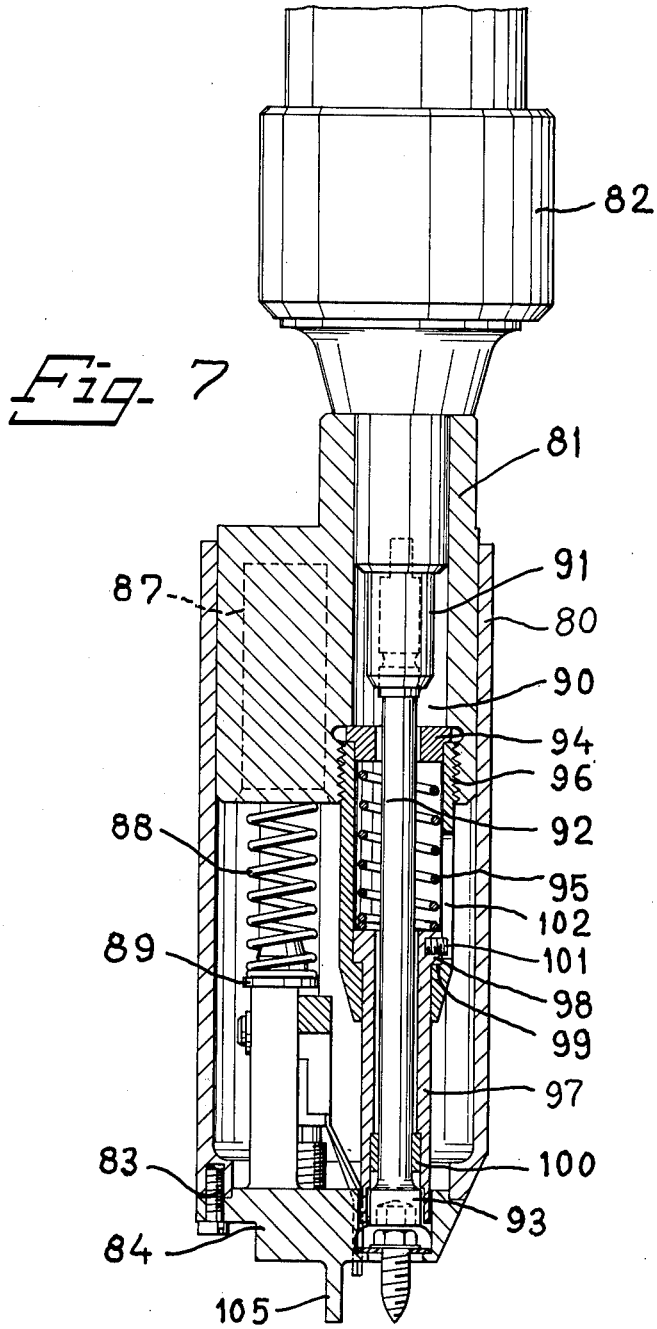
FIG. 7 is an axial, vertical cross-sectional view, taken generally along the line VII—VII in FIG. 10 of the screwdriver of FIG. 6.
Figure 8:
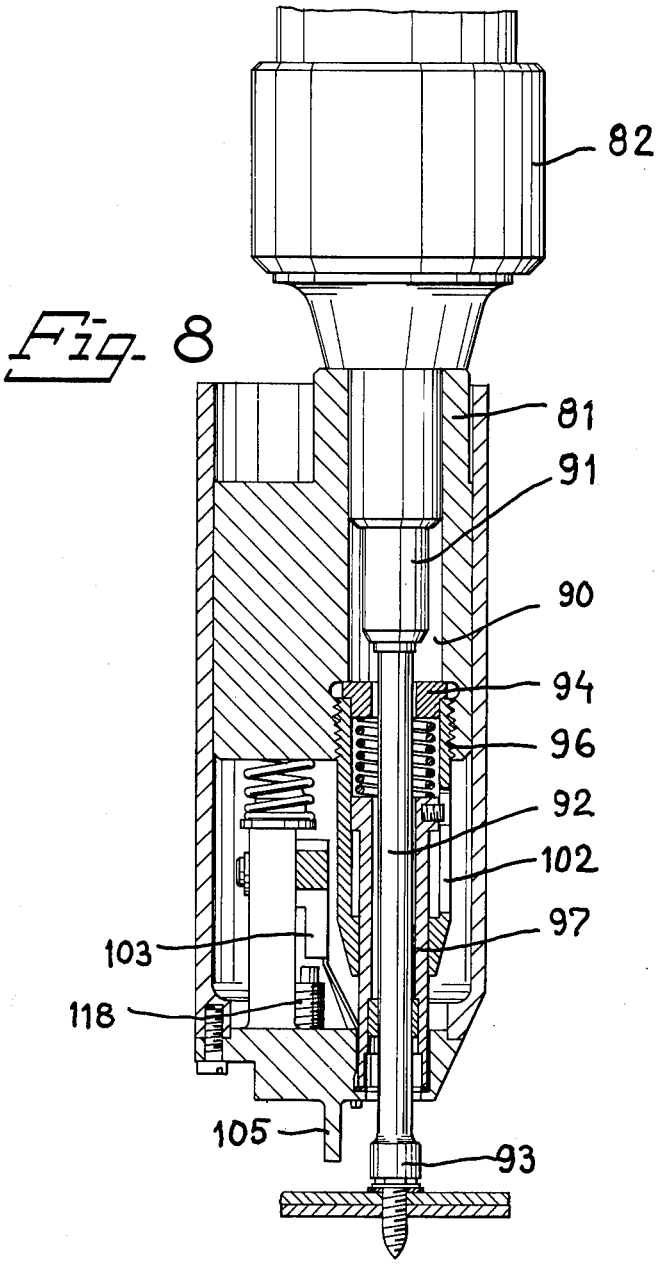
Figure 9:
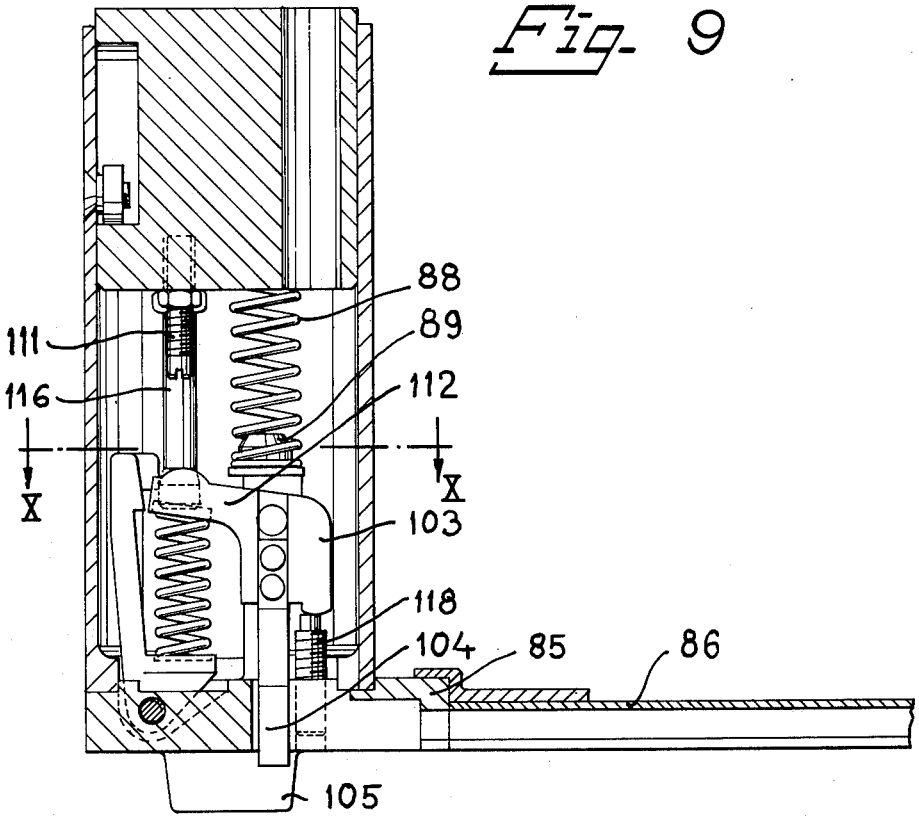
Figure 10:
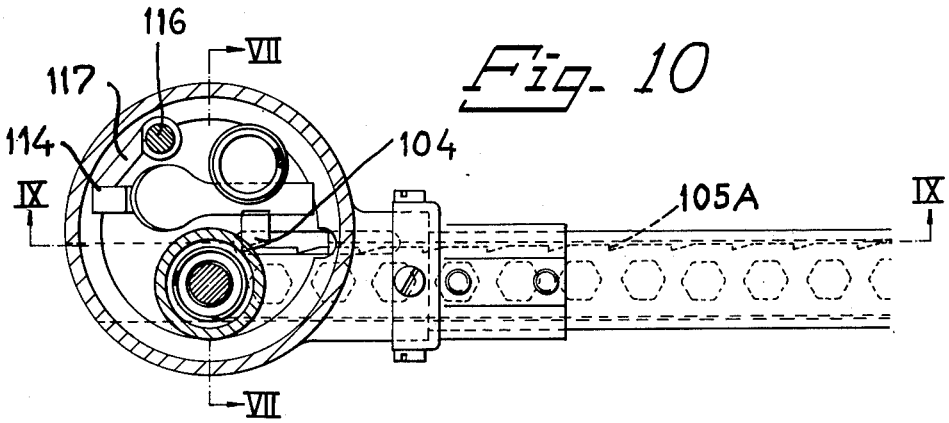

FIG. 8 corresponds to FIG. 7, showing the parts at the end of the screwdriving stroke;

FIG. 9 is a vertical, axial cross-sectional view, taken generally along the line IX—IX in FIG. 10 of the lower part of the screwdriver of FIG. 6, the parts being shown after a completed screw feeding;

FIG. 10 is a cross-sectional view taken generally along the line X—X in FIG. 9 showing the screwdriver of FIG. 6.

FIG. 11 corresponds to FIG. 9, but shows the parts after a completed screwdriving stroke and at the beginning of the screwfeeding stroke; and FIG. 12 is an enlarged axial cross-sectional view of the lower part of the screwdriver of FIG. 6.

AS SHOWN ON THE DRAWINGS

As shown in FIGS. 1–5, the first embodiment of the screwdriver comprises a mechanism housing 10, to the lower part of which a screw magazine 11 is affixed. The magazine 11 has a cover 12 that can be opened for loading screw strips, for instance so called drywall screws 13, (FIG. 3) which are attached in a row, parallel to each other, on or between carrying strips, such as the strips 14, 15. The screw strips are usually wound spirally in rolls containing 300 screws, for example.

The mechanism housing 10 comprises an upper cylindrical part 16 (FIG. 2) also referred to herein as a plunger member, which narrows at its upper end to form an end wall 17, from which an externally threaded sleeve 18 extends. The sleeve 18 is screwed into an internally threaded nose end 19 of a driving device 20, shown only partly, the driving device being the same as used in a convential electric hand drill but which has been slightly modified to suit this particular application. Between the end wall 17 and the end surface of the nose end 19, there is a ring 21, the purpose of which is to make it possible, on assembly, to suitably control the final angular position of the housing 10 and the magazine 11 in relation to the handle of the driving device 20, i.e., by grinding down the thickness of the ring 21 to a selected extent.

The housing part 16 carries an axially displaceable but nonrotatable socket 22, which at its lower end carries a nose body 23, containing the feeding mechanism of the screwdriver. The nonrotatable guiding of the socket 22 on the housing part 16 is achieved by means of a screw 24 screwed into the housing part 16, the head of the screw 24 running in an axial slot 25 in the socket 22. When axial force is applied to the driving device 20, the housing part or plunger member 16 is axially pushed into the socket 22 against the force of a helical return spring 26, which abuts against the underside of the end wall 17 and the upperside of the nose body 23, respectively, and which is guided on a guide pin 27.

A spindle 29 is rotatably, and axially displaceably journalled in a bearing socket 28 in the sleeve 18. The spindle 29 is rigidly secured to one part 30 of a coupling, the second part 31 of which is driven continuously by the driving device 20. The coupling 30, 31 is of a known type and will therefore not need any further description. The coupling parts 30, 31 at rest are kept apart from each other by means of a spring biased pin 32 and are brought into engagement with each other by the axial force, which is exerted against the driving device 20 during the driving of a screw. The lower end of the spindle 29 is threaded and carries a mounting 33 for a screwdriver bit 34, which mounting is described in more detail below with reference to FIG. 5.

Figure 1:
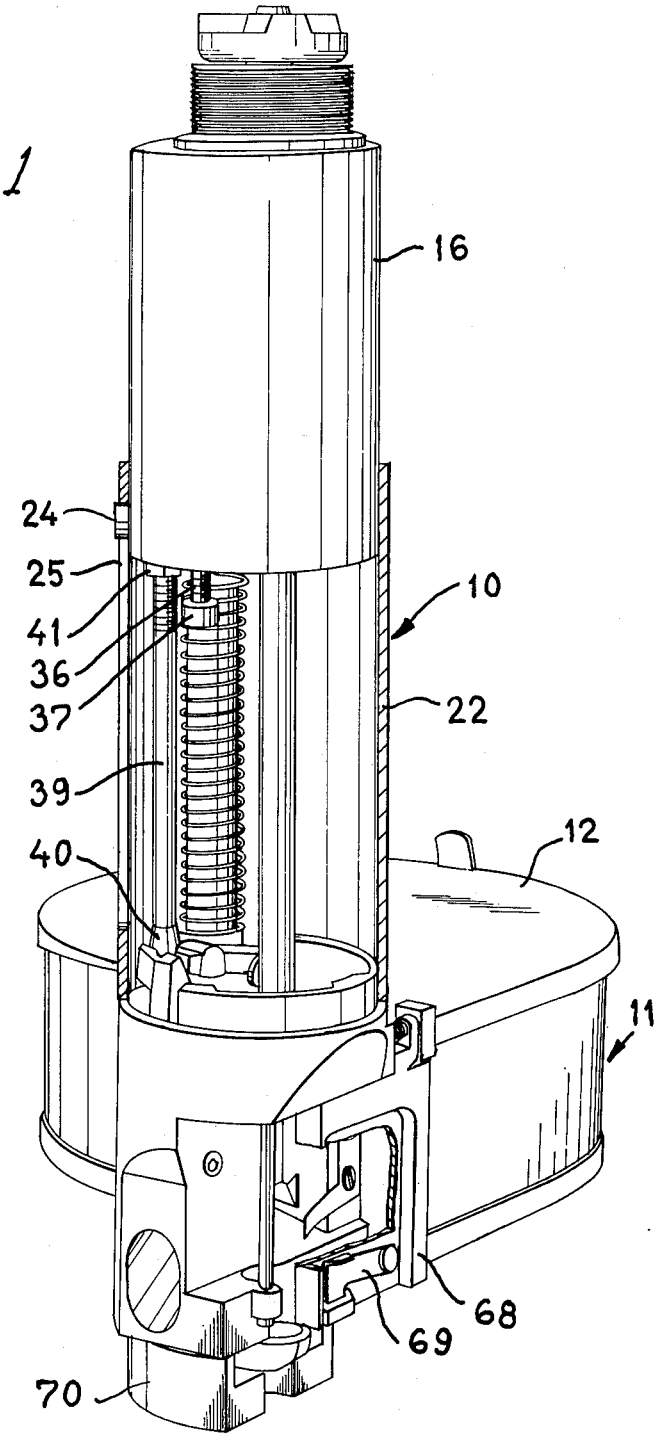
FIG. 1 is a perspective view, partly in cross-section, of a first embodiment of a screwdriver according to the invention.

Into an abutment or end wall 35 formed as a thickening inside the housing part 16, there is screwed a short axially adjustable thrust pin 36 with a head 37, lockable in its adjusted position by a lock nut 38 acting against the underside of the end wall 35. Adjacent to the thrust pin 36, an axially adjustable release pin 39 is fastened to the end wall 35, the release pin 39 having a head 40 at its lower end. The release pin 39 is similarly axially lockable in its adjusted position by means of a lock nut 41, only shown in FIG. 1. The mutual positions of the thrust pin 36 and the release pin 39 are best shown in FIG. 1. The thrust pin 36 is adapted to act with its head 37 on a bell crank 42 of the feeding mechanism, FIGS. 2 and 3, while the release pin 39 is adapted to act with its head 40 on a lock pawl 43 for the bell crank 42, as is described more fully below.

Figure 2:
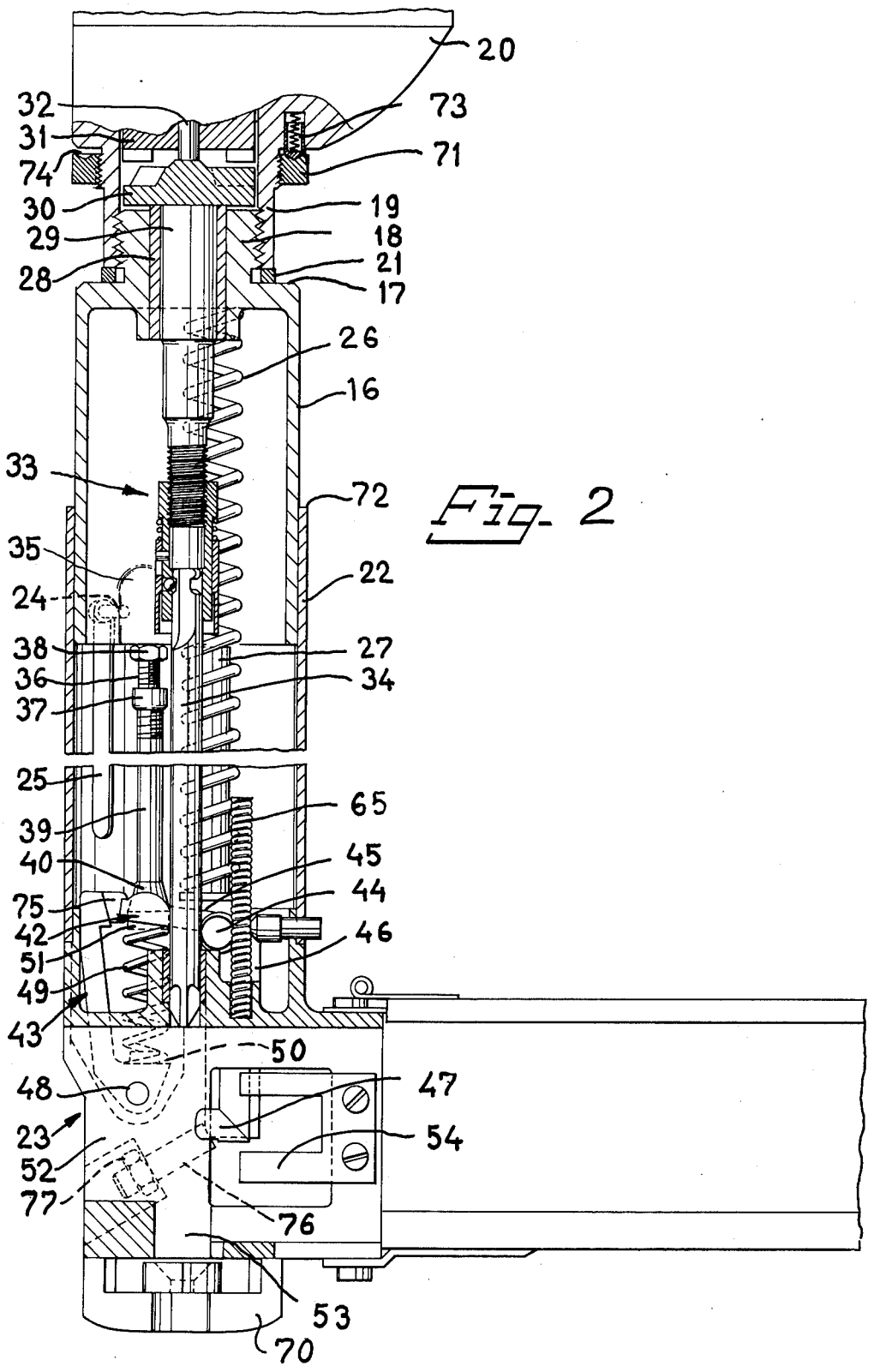
FIG. 2 is an axial vertical longitudinal cross-sectional view of the screwdriver of FIG. 1.

The bell crank 42 is pivotally journalled on a pivot pin 44 on the nose body 23 and has one nearly horizontal drive arm 45 and one nearly vertical feed arm 46, the arm 46 having a feeding spring 47, FIGS. 2 and 4, engaging with the screws 13.

The lock pawl 43 is pivotally journalled on a pivot pin 48 in the nose body 23, and is biased to pivot clockwise as shown in FIGS. 2 and 3 by a spring 49. The spring 49 acts at its lower end on a spring seat 50 on the lock pawl 43, and at its upper end against a spring seat 51 on the underside of the bell crank arm 45. As shown in FIG. 2, the spring seat 50 is placed slightly to the right of an imaginary vertical plane through the pivot pin 48, which position gives the lock pawl 43 a tendency to pivot clockwise as shown in FIGS. 2 and 3 into its locking position shown in FIG. 3.

The nose body 23 has a through-going channel 52 to enable the screws 13 to pass to a stand-by position 53 for driving in, and to enable discharge of the carrying strips 14, 15 after the application of the screws. On a sidewall of the through-going channel 52, there is a locking spring 54, which prevents the screw strip from being pushed back toward the magazine, while the feeding bell crank 42 pivots counterclockwise to the position shown in FIG. 3 to engage behind a succeeding screw 13 for subsequently feeding it to the standby position 53.

Figure 5:
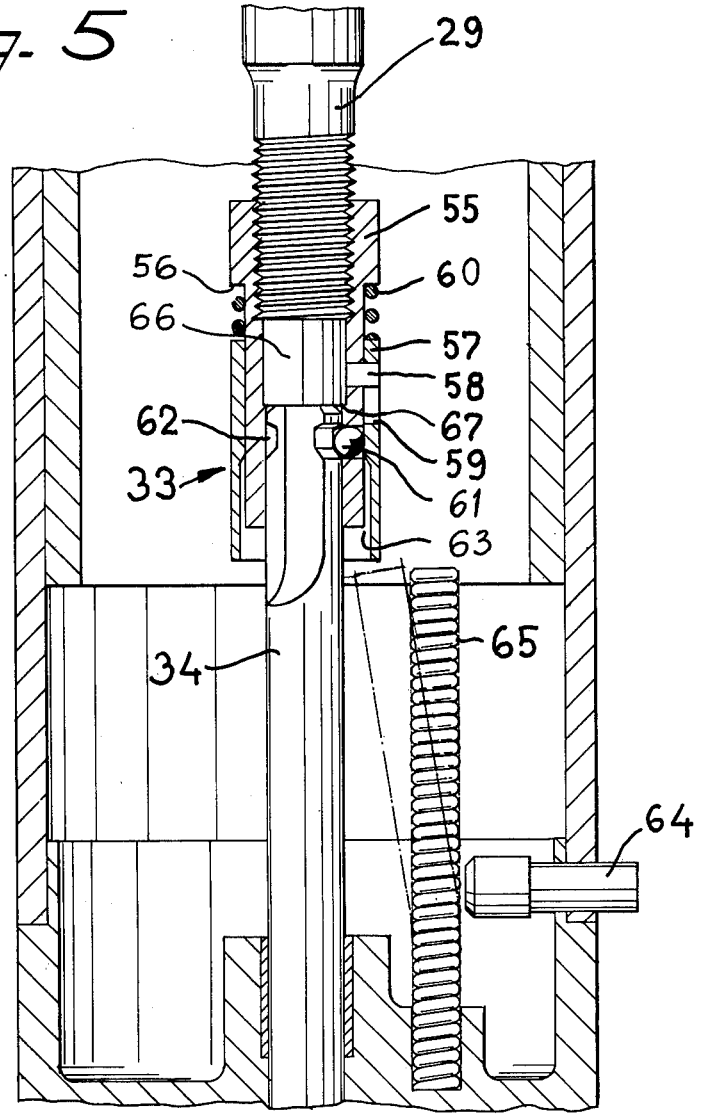
FIG. 5 is an enlarged axial cross-sectional view of the bit mounting of the screwdriver in FIGS. 1–4.

As shown in FIG. 5, the threaded end of the spindle 29 of the bit mounting 33 carries a socket 55 which is externally slightly reduced to form a spring seat 56. On the reduced diameter socket portion, an axially movable ball retaining or lack sleeve 57 is carried. A pin 58 in the socket 55 extends into an axial slot 59 in the sleeve 57, and prevents the sleeve from turning relatively to the socket 55, but permits axial shifting of the sleeve 57 on the socket 55 within the limits set by the length of the slot 59. Normally, the sleeve 57 is held in its locking position relative to the socket 55 by means of a spring 60, the upper end of which rests against the spring seat 56 and the lower end of which acts against the upper edge of the sleeve 57. In the lower or locked position of the sleeve 57, it maintains one or a plurality of locking balls 61, for instance three such balls, in their radially innermost position, wherein they lockingly engage in a circumferential groove 62 in the upper splined or fluted end of the bit 34. The balls 61 are disposed in radially through-going bores in the wall of the socket 55. The ball retaining sleeve 57 has, in the lowermost part thereof, a slightly larger internal diameter than the outer diameter of the socket 55, so that a radial clearance 63 is provided.

When the ball retaining sleeve 57 is pushed upwardly on the socket 55, against the action of the spring 60, the balls 61 may shift outwardly and permit the bit to be pulled out axially. The axial displacement the sleeve 57 on the socket 55 is brought about by a pin 64 which can deflect the upper end of a spring 65, as shown in dot-dash lines, into the path of the sleeve 57 for engagement therewith during the downward shifting of the spindle 29.

A metal slug 66 is disposed between the lower end of the spindle 29 and the upper end of the bit 34. The slug 66 rests on a ledge 67 at the upper end of a female or flute arrangement in the socket 55 and therefore an accurately defined position of the internal surface is provided, against which the bit 34 engages, viz, the underside of the slug 66. Thus, the balls 61 are only utilized to hold the bit 34, but not to transfer any axial thrust to the bit 34. At the assembly of the screwdriver, it is possible to ensure that the slug 66 becomes rigidly clamped between the end surface of the spindle 29 and the ledge 67 by grinding down the height of the slug 66 to a selected length.

The nose body 23 of the screwdriver has, on one side thereof, a pivotable shutter 68, which is lockable in closed position by means of a pivoted hook 69. In FIG. 1 the shutter is shown partly broken away. By opening of this shutter, access to the feeding mechanism for the screws is obtained, so that on each loading of the magazine with a fresh screw-strip, the outer end of the strip may be place in correct position in relation to the feeding mechanism to enable the first screw on the strip to be driven in correctly.

The embodiment of the screwdriver as shown in FIGS. 1–5 operates in the following way:

First the magazine 12 is loaded with a screw-strip, and with the shutter 68 opened, the outer end of the screw-strip is so placed, that the first screw on the strip takes a stand-by position, viz, the position denoted 53 in FIG. 2. The cover 12 of the magazine and the shutter 68 are closed, whereupon the screwdriver is ready to be operated. A point portion 70 of the nose body 23 is then placed against the workpiece into which the screw is to be applied.

The drive device 20 is started at the same time as a gentle axial force is applied to the drive device. The housing portion 16 then starts to enter into the surrounding sleevelike housing portion 22, and soon the point of the bit 34 engages the head of the screw 13 in the stand-by position 52 (Typically the screws have a concial spline drive recess, or cross recess, and the end of the bit is correspondingly shaped). As soon as a resistance arises against the axial shifting of the bit 34, the force which normally holds the coupling parts 30, 31 axially apart from each other is overcome, whereby the rotational driving engagement within the coupling 30, 31 is established. Thereby the spindle 29 and the bit 34 are put into rotation, whereby the rotation of the screw 34 starts. In some instances, the initial rotation of the bit establishes full engagement of the bit end with the drive grooves of the screw.

Under a comparatively small axial thrust against the drive device 20, the driving of the screw then continues and simultaneously the housing portion 16 enters further into the housing portion 22 until an ajustable stop-ring 71 engages an abutment 72, here the upper edge of the sleeve-like housing portion 22. The screw is now almost driven in, but not fully. Though no further axial thrust is applied to the bit after the just mentioned engagement, the drive connection with the coupling 30, 31 is maintained for a short interval and thus the turning movement of the screw continues, until the screw is fully seated. Usually it is driven so that its head is recessed one or a few fractions of a millimeter below the surface of the workpiece, such as a plasterboard panel. Since there is friction between the point of the bit and the drive grooves of the screw during the final portion of the screwing, there is a tendency for the bit 34 and the spindle 29 to be pulled axially towards the working piece (downwardly in FIG. 2). This tendency for further axial movement is aided by the axial force of th spring-loaded pin 32 in the coupling, which urges the coupling parts 30, 31 apart from each other. Because of the above continued turning movement of the screw, the bit 34 and the spindle 29, and the resulting inertial movement of said parts and of the coupling part 30 rigidly secured thereto, the coupling parts 30, 31 will be separated from each other, whereby the rotating of the spindle 29 and thus the screw advance will stop. The drive device 20 may be left running and the screwdriver nose 70 may be kept pressed against the workpiece. When the rotary and axial movement of the bit 34 and the spindle 29 have stopped, the disengaged condition of the coupling 30, 31 is maintained by means of the spring-biased pin 32.

To make the disengagement of the coupling take place at the right moment, so that exactly the desired recessing of the screw into the workpiece is achieved, it is necessary to exactly adjust the position in which the drive device 20 and the upper housing portion 16 are stopped in their axial movement towards the workpiece. To this end, the stop-ring 71 is screwed on the end of the drive device 20 by means of a screw thread of a rather small pitch, for instance on the order of 1 mm. Furthermore, in the lower end of the drive device 20 there is disposed a spring biased latch pin 73 which is adapted to resiliently enter into one of a number of recesses 74 in the upper surface of the ring 71 to lock the ring against unintentional turning. For instance, if the ring 71 has ten circumferentially equally spaced recesses 74 and the pitch is 1 millimeter, the above described disengagement position of the coupling, and therewith the recessing depths of the screws, may be adjusted in steps of 0.1 millimeter.

Near the end of the driving stroke of the screw, the head 37 of the pin 36 hits the arm 45 of the bell crank 42 and pivots the bell crank 42 counterclockwise on the pivot pin 44, whereby the feeding spring 47 engages behind the next following screw 13 on the strip. At the same time, the spring 54 prevents the strip from being pushed back into the magazine 11. As the bell crank 42 pivots counterclockwise to the position shown in FIG. 3, the spring 49 becomes slightly compressed, which spring thereby, due to its eccentric mounting in relation to the pivot pin 48, brings about a pivotal clockwise movement of the lock pawl 43 on the pivot pin 48, so that the lock pawl engages over and locks the arm 45 of the bell crank 42. The parts of the feeding mechanism then remain in the described position as shown in FIG. 3, until the application of the screw has been completed, the axial thrust has been relieved, and the various parts of the screwdriver carried by the housing part 16 have almost resumed the retracted position according to FIG. 2. Shortly after the bit 34 has been retracted from the feeding path of the screw-strip, namely just before the end of the return stroke of the parts, a cam surface on the head 40 of the pin 39 engages with a projection 75 on the lock pawl 43, by which the lock pawl 43 is pivoted counterclockwise out of gripping engagement with the bell crank 45. The bell crank 45 under the influence of the spring 49 instantaneously pivots clockwise to feed the next following screw into the standby position 53 by means of the spring 47.

The screw 13 must be stopped in a position exactly in line with the bit 34 and therefore the bell crank arm 46 is arranged to be stopped against an adjustable stop or pin 76, which is adjustable from the outside of the device and is lockable in its adjusted position by means of a jam nut 77.

The point portion 70 of the screwdriver preferably has a rounded underside, as shown in FIGS. 2 and 3, in order to avoid making marks on the surface of the workpiece. Furthermore, the point portion 70 preferably has guide means to guide the screws as they have been separated from the carrying strip. In the example such guide means comprise two jaws 78, 79, which are spring biased towards each other and are so built and arranged that they may be moved apart from each other to permit the passage of the screw heads.

A second embodiment of the screwdriver according to this invention is shown in FIGS. 6–12 and is in many respects similar to the first embodiment. The second embodiment is adapted to be used with rather short screws, which are arranged on a strip with the screw shanks extending through the strip and the screw heads resting against one side of the strip.

The screwdriver in FIGS. 6–12 comprises a cylindrical housing 80, in the upper part of which a holder 81 for a drive device 82 is axially shiftable but nonrotatably guided. To the lower part of the housing 80, a nose body 84 is attached by means of one or more screws 83, which body, at one side, is provided with a feeding channel 85, to which is connected a downwardly open feeding channel 86 for the screw strips. The holder 81 has a downwardly open blind-bottom hole 87, which houses the upper end of a return spring 88, the lower end of which rests on a spring seat 89 on the upper side of the nose body 84. Further, the holder 81 has an axial bore 90 for a drive spindle 91 and the tool 92, which, in the example shown, at its lower end has a hexagonal drive socket 93 for engagement with the hexagonal heads of the screws.

A bushing 94, inserted into the bore 90 from below, rests against a ledge on the wall of the bore 90 and acts as a seat for the upper end of a spring 95, and the bushing 94 is kept in place by means of a sleeve 96 which is screwed into the lower, threaded end of the bore 90. Assembled from above into the sleeve 96, there is disposed therein a pressure sleeve 97, which on its upper part has an annular flange 98, which normally rests on an internal ledge 99 at the lower end of the sleeve 96. The pressure sleeve 97 is resiliently held in its rest position shown in FIG. 7 by the spring 95, the lower end of which rests against the ring flange 98. The sleeve 97 at its lower end is provided with an internal journal sleeve 100 to rotatably and axially movably journal the shank of the tool 92. The sleeve 97 has a lower end in the rest position extending around the drive socket 93 of the tool 92 with a small clearance, and either fully or nearly fully receiving the socket 93 axially. The sleeve 97 is prevented from rotating by means of a pin 101, which is screwed into the annular flange 98 and is guided in an elongated slot 102 in the wall of the sleeve 96.

The feeding mechanism of the screwdriver according to FIGS. 6–12 in principle is very similar to the above described feeding mechanism of the screwdriver according to FIGS. 1–5. Thus repititious description is omitted. The downwardly extending arm of the bell crank 103 is provided with a spring 104, which is adapted, at the feeding stroke, to engage with one flank of a cut out or notch 105A in the screw carrying strip. Other constructional features of the screwdriver according to FIGS. 6–12 will appear from the following description of the operation of the screwdriver.

Instead of using a movable screwdriver for driving in screws into a stationary workpiece, it is possible to arrange the screwdriver in a stationary position and move the workpiece in relation to the screwdriver.

Assuming now that the screwdriver has been loaded with a screw-strip so that the first screw on the strip is situated in a standby position axially in line with the tool 92, the screwdriver is placed in a suitable position for screw application, at which preferably a tongue 105 on the nose body 84 can rest against the workpiece. The height of the tongue is preferably such that the tongue extends axially slightly below the point of the screws, FIG. 7.

With the screwdriver placed in a suitable position the drive device 82 is started, and a gentle axial thrust is applied to the screwdriver, overcoming the force of the return spring 88, The hexagonal drive socket 93 engages over the head 107 of the screw 106, FIG. 12, at substantially the same time as the underside of the sleeve 97 is pressed onto the screw carrying strip 108. As the drive socket 93 passes through the strip 108, while driving the screw 106, it releases the screw 106 from the strip together with a ring-shaped disk 109 on the underside of the screwhead, which disk will thereafter serve as a sealing or locking disk. Thus, the drive socket 93 serves as a punch to punch out the disk 109 in cooperation with an internal ring-shaped die 110 in the nose body 84. The separation of the disk 109 from the strip at the screw application is facilitated if the strip has circular lines of weakness of curved indications of fracture, all the way through the strip, if desired. Between such circular curved indications of fracture there may be left only very thin connection webs which are cut off at the screwdriving step. During the separation of said disk from the strip, the strip is firmly held by the underside of the pressure sleeve 97, which presses the strip against the internal die 110.

In the similar way as with the embodiment according to FIGS. 1–5, near the end of the screwdriving stroke, an adjustable pin 111 on the underside of the holder 81 strikes an arm 112 of a pivotally journalled bell crank 103, and pivots the bell crank 103 counterclockwise to the position shown in FIG. 11, and the bell crank 103 slightly compresses an eccentrically disposed spring 113, which in turn brings about a clockwise pivoting of a lock pawl 114 into locking position shown in FIG. 11. Then, the parts of the feeding mechanism remain in the described position until, following a completed screwdriving step and the relieving of the axial thrust on the screwdriver. An enlarged head 115 on a release pin 116, screwed into the holder 81 from below, hits a projection 117 on the lock pawl 114 and pivots the lock pawl 114 counterclockwise into a release position. Thereby the spring 113 pivots the bell crank 103 so that its spring 104 while engaging into a "feeding notch" 105A feeds the screw-strip forward by one step. The length of the feeding stroke may be exactly controlled by means of a pin 118 inserted into the nose body from below, against which pin the lower part of the bell crank 103 strikes.

In the embodiment shown in FIGS. 6–12, no spring or the like is needed to prevent the strip from being pushed back while the feeding mechanism is being cocked. During the cocking of the feeding mechanism, the strip is firmly held by the sleeve 97, which presses the strip 108 against the internal die 110, FIG. 12.

Words of direction herein, such as "vertical," "lower" and the like have been used only as terms of reference with respect to the drawing, as the device can be operated by hand in any attitude with respect to gravity.

Although various minor modifications may be made by those skilled in the art, it should be understood that I wish to embody herein all such modifications as reasonably come within the scope of my contribution to the art.

I claim as my invention:

1. A power-driven screw driver for use with a strip of screws, comprising:

a. a body engageable with a workpiece;
b. a plunger member slidably disposed in said body;
c. a return spring normally acting between and biasing said body and said plunger member apart;
d. power-drive means carried on said plunger outside of said body;
e. a screwdriver tool rotatably carried on said plunger and adapted to be driven by said power-drive means;
f. guide means on said body for guiding a strip of screws successively into alignment with said screwdriver tool;
g. a bellcrank pivoted on said body and having (1) a feed arm carrying a spring engageable with the strip of screws for advancing it incrementally, and (2) a drive arm;
h. a first projection on said plunger member engageable with said drive arm near the end of a screw driving stroke;
i. a pawl pivoted on said body and having a hook for locking said bellcrank in a cocked position;
j. a feed spring acting between said pawl and said bellcrank, and held in a loaded position by engagement of said hook with said bellcrank; and
k. a second projection on said plunger member engageable with said pawl to effect unlocking thereof near the end of a retracting stroke of said plunger member.

2. A screwdriver according to claim 1 in which said feed spring acts on said pawl eccentrically to its pivot for urging it into an interlocked position with said drive arm of said bellcrank.

3. A screwdriver according to claim 1 in which the effective length of at least one of said projections is adjustable.

4. A screwdriver according to claim 1 including an adjustable stop carried by said body for limiting the amount of feeding movement of said bellcrank.

5. A power-driven screwdriver according to claim 1 including:

a. a sleeve carried by said plunger in surrounding relation to the screw-engaging portion of said tool and having an annular end face adapted to engage the strip in surrounding relation to the head of the screw.

6. A screwdriver according to claim 5 in which said sleeve is axially slidably carried on said plunger for axial movement with respect to said tool, and a spring normally urging said sleeve toward the strip.

7. A screwdriver according to claim 5 in which said body has means defining a die opening between which means and said annular end the strip passes.

8. A screwdriver according to claim 7 in which the screw-engaging portion of said tool has an external configuration which comprises that of a rotary punch coactive with said die means on the strip.

9. A screw driver according to claim 1 including:

a. a rotatable spindle on said plunger interconnecting said power drive means with said screw driver tool;

b. a spring-loaded lock sleeve axially slidable on said spindle and normally retaining said screw driver tool;

c. a resilient unlocking device supported on said body; and d. a pin slidably carried on said body and arranged to selectably deflect said resilient unlocking device into the path of said lock sleeve, whereby, on subsequent advance of said plunger member, said lock sleeve is relatively moved on said spindle with respect to the screw driving tool against its spring bias to release said tool.

10. A screw driver according to claim 1, including a sleeve carried by said plunger member in surrounding relation to the screw-engaging portion of said tool and having an annular end face adapted to engage the strip in surrounding relation to the head of the screw.

11. A screwdriver according to claim 10 in which said sleeve is axially slidably carried on said plunger for axial movement with respect to said tool, and a spring normally urging said sleeve toward the strip.

12. A screwdriver according to claim 10 in which said body has means defining a die opening between which means and said annular end the strip passes.

13. A screwdriver according to claim 10, in which the screw-engaging portion of said tool has an external configuration which comprises that of a rotary punch coactive with said die means on the strip.

14. A power-driven screwdriver for use with a strip of screws, comprising:

a. a body engageable with a workpiece;

b. a plunger member slidably disposed in said body;

c. a return spring normally acting between and biasing said body and said plunger member apart;

d. power-drive means carried on said plunger outside of said body;

e. a screwdriver tool rotatably carried on said plunger and having a separable drive connection with said power-drive means;

f. guide means on said body for guiding a strip of screws successively into alignment with said screwdriver tool;

g. feed means on said body automatically responsive to the relative movement between said plunger member and said body for advancing the strip to place the next screw in alignment with said tool;

h. a spring-loaded axially slidable lock sleeve forming a part of said separable drive connection and normally retaining said screwdriver tool;

i. a resilient unlocking device supported on said body; and j. a pin slidably carried on said body and arranged to selectably deflect said resilient unlocking device into the path of said lock sleeve, whereby, on subsequent advance of said plunger member, said lock sleeve is relatively moved with respect to the screw driving tool against its spring bias to release said tool.

* * * * *